US006422858B1

(12) United States Patent
Chung et al.

(10) Patent No.: US 6,422,858 B1
(45) Date of Patent: Jul. 23, 2002

(54) LOW $NO_X$ APPARATUS AND METHODS FOR BURNING LIQUID AND GASEOUS FUELS

(75) Inventors: I-Ping Chung; Joseph Colannino, both of Tulsa, OK (US); Christoph Strupp, Igel-Liersberg (DE)

(73) Assignee: John Zink Company, LLC, Tulsa, OK (US)

( * ) Notice: Subject to any disclaimer, the term of this patent is extended or adjusted under 35 U.S.C. 154(b) by 0 days.

(21) Appl. No.: 09/659,399

(22) Filed: Sep. 11, 2000

(51) Int. Cl.[7] ..... F23C 5/00

(52) U.S. Cl. ..... 431/8; 431/10; 431/278; 431/284; 431/285

(58) Field of Search ..... 431/8, 10, 215, 431/278, 284, 285, 178, 187, 188, 190

(56) References Cited

U.S. PATENT DOCUMENTS

| | | | | |
|---|---|---|---|---|
| 2,103,605 A | * | 12/1937 | Zink | 431/187 |
| 4,004,875 A | | 1/1977 | Zink et al. | 431/9 |
| 4,162,140 A | | 7/1979 | Reed | 431/284 |
| 4,257,763 A | * | 3/1981 | Reed | 431/188 |
| 4,347,052 A | * | 8/1982 | Reed et al. | 431/188 |
| 5,098,282 A | | 3/1992 | Schwartz et al. | 431/9 |
| 6,027,330 A | | 2/2000 | Lifshits | 431/8 |

FOREIGN PATENT DOCUMENTS

| | | |
|---|---|---|
| EP | 0 774 620 A1 | 5/1997 |
| EP | 0 967 437 A1 | 12/1999 |

* cited by examiner

*Primary Examiner*—James C. Yeung
(74) *Attorney, Agent, or Firm*—C. Clark Dougherty, Jr.

(57) ABSTRACT

Low $NO_x$ apparatus and methods for burning liquid and gaseous fuels are provided by the present invention. The apparatus of the invention is basically comprised of a housing having an open discharge end attached to a furnace space, means for introducing a controlled quantity of air into the housing and into the furnace space, a combustion compartment disposed within the housing for providing a primary combustion zone therein having an open inlet end for receiving a portion of the air introduced into the housing and an open discharge end, a liquid fuel nozzle attached to the housing for discharging liquid fuel into the primary combustion zone, at least one primary gaseous fuel nozzle for discharging primary gaseous fuel into the primary combustion zone and at least one secondary gaseous fuel nozzle for discharging secondary gaseous fuel into the furnace space.

27 Claims, 3 Drawing Sheets

LOW $NO_x$ APPARATUS AND METHODS FOR BURNING LIQUID AND GASEOUS FUELS

BACKGROUND OF THE INVENTION

1. Field of the Invention

The present invention relates to low $NO_x$ producing burner apparatus and methods, and more particularly, to such apparatus and methods for separately or simultaneously burning liquid and gaseous fuels.

2. Description of the Prior Art

Because of stringent environmental emission standards adopted by government authorities and agencies, burner apparatus and methods have heretofore been developed which suppress the formation of nitrogen oxides ($NO_x$) in flue gases produced by the combustion of fuel-air mixtures; For example, burner apparatus and methods wherein liquid or gaseous fuel is burned in less than a stoichiometric concentration of air to lower the flame temperature and thereby reduce thermal $NO_x$ have been developed. That is, staged air burner apparatus and methods have been developed wherein the liquid or gaseous fuel is burned in a deficiency of air in a first combustion zone whereby a reducing environment which suppresses $NO_x$ formation is produced, and the remaining portion of the air is introduced into a second zone downstream from the first zone wherein the unburned remaining fuel is combusted.

Staged liquid or gaseous fuel burner apparatus have also been developed wherein all of the air and some of the fuel is burned in a first zone with the remaining fuel being burned in a second downstream zone. In such staged fuel burner apparatus and methods, an excess of air in the first zone functions as a diluent which lowers the temperature of the burning gases and thereby reduces the formation of $NO_x$.

Staged air burner apparatus and methods have most commonly been utilized for combusting liquid fuels while staged fuel burner apparatus and methods have been most commonly utilized for combusting gaseous fuels. However, burner apparatus and methods which can be selectively utilized for combusting liquid fuels or gaseous fuels or for simultaneously combusting both liquid fuels and gaseous fuels which have heretofore been developed have not met much success in reducing $NO_x$ emissions.

Thus, there are needs for improved burner apparatus and methods for separately or simultaneously burning liquid and gaseous fuel which produce flue gases having low $NO_x$ content.

SUMMARY OF THE INVENTION

By the present invention low $NO_x$ producing burner apparatus and methods for separately or simultaneously burning liquid and gaseous fuels are provided which meet the needs described above and overcome the deficiencies of the prior art. That is, in accordance with the present invention, a low $NO_x$ forming burner apparatus for burning liquid and gaseous fuels adapted to be connected to a furnace space is provided; The burner apparatus includes a housing having an open discharge end attached to the furnace space and a closed opposite end. Means for introducing a controlled quantity of air into the housing and into the furnace space are attached to the housing. A combustion compartment is disposed within the housing for providing a primary combustion zone therein having an open inlet end for receiving a portion of the air introduced into the housing as primary air and an open discharge end adjacent to the open end of the housing. The combustion compartment is smaller than the housing whereby a portion of the air introduced into the housing passes through the annular space between the exterior of the compartment and the interior of the housing and is discharged from the annular space at the discharge ends of the housing and the combustion compartment as secondary air. A liquid fuel nozzle is attached to the housing for connection to a source of liquid fuel and for discharging liquid fuel into the primary combustion zone within the combustion compartment so that the liquid fuel mixes with primary air therein, is combusted therein and is discharged into the furnace space wherein it mixes with the secondary air discharged into the furnace space and is further combusted therein. At least one primary gaseous fuel nozzle is attached to the housing for connection to a source of gaseous fuel and for discharging primary gaseous fuel into the primary combustion zone within the combustion compartment so that the gaseous fuel mixes with primary air therein, is combusted therein and is discharged into the furnace space. At least one secondary gaseous fuel nozzle is also attached to the housing for connection to a source of gaseous fuel and for discharging secondary gaseous fuel into the furnace space which mixes with the secondary air therein and is combusted therein.

The methods of the present invention basically comprise the following steps. A first portion of primary air is mixed with a liquid fuel in a primary combustion zone in a burner to form a fuel-rich mixture. The fuel-rich mixture is burned in the primary combustion zone whereby flue gases having low $NO_x$ content are formed therefrom and the flue gases and unburned liquid fuel are discharged into the furnace space. A second portion of primary air is mixed with a first portion of a gaseous fuel in the primary combustion zone in the burner and the resulting air-gaseous fuel mixture is burned in the primary combustion zone whereby flue gases having low $NO_x$ content are formed therefrom and are discharged into the furnace space. A second portion of the gaseous fuel is discharged into the furnace space and secondary air is discharged into the furnace space so that the secondary air mixes with flue gases in the furnace space, the gaseous fuel discharged therein and the unburned liquid fuel discharged therein and the resulting mixture is burned in a secondary combustion zone in the furnace space whereby additional flue gases are formed having low $NO_x$ content.

It is, therefore, a general object of the present invention to provide improved low $NO_x$ apparatus and methods for burning liquid and gaseous fuels.

Other and further objects, features and advantages of the present invention will be readily apparent to those skilled in the art upon a reading of the description of preferred embodiments which follows when taken in conjunction with the accompanying drawings.

DESCRIPTION OF THE PREFERRED EMBODIMENTS

Figure 2:
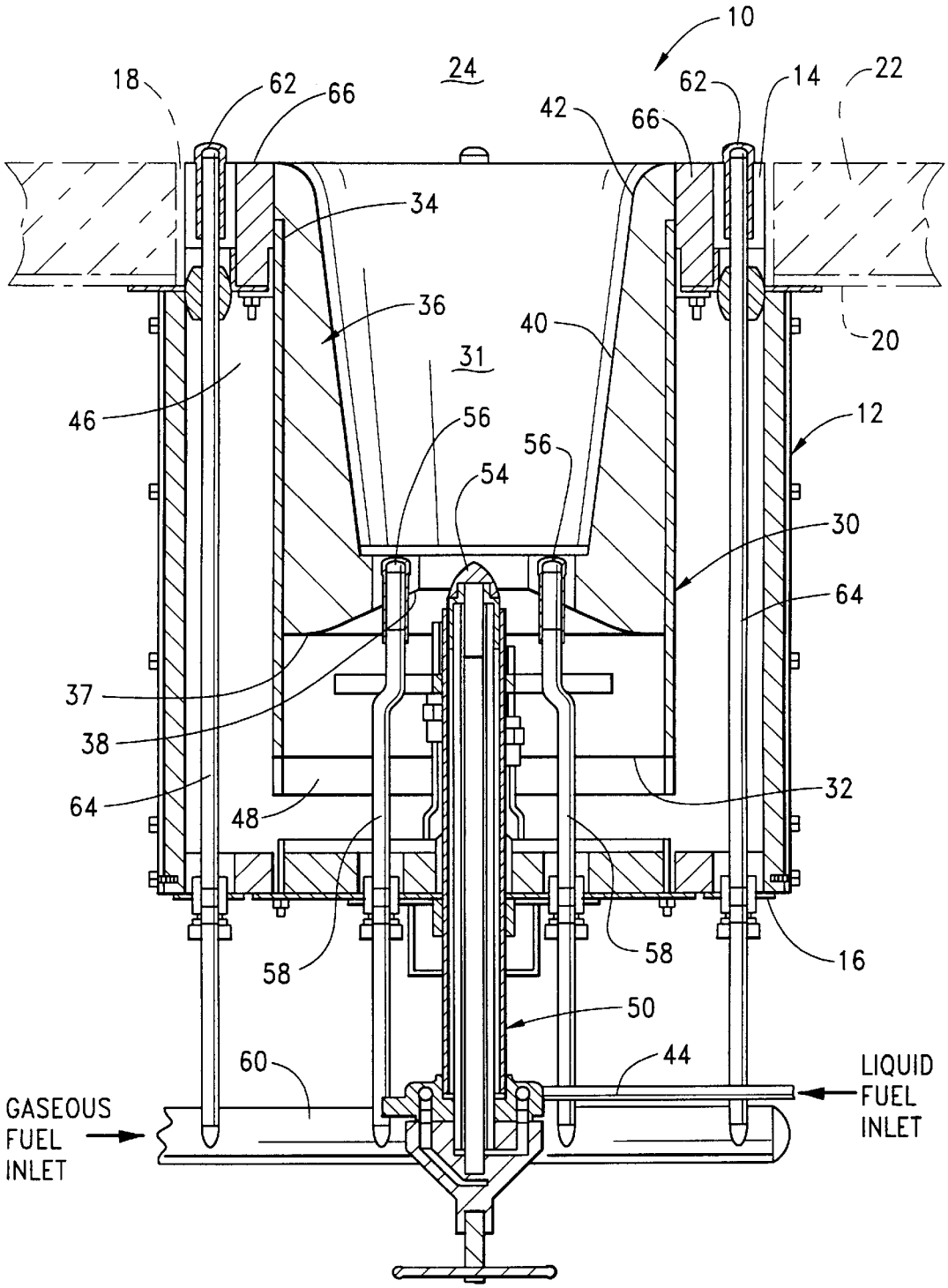
FIG. 2 is a side cross-sectional view of the burner apparatus of FIG. 1 taken along line 2—2 of FIG. 1 and showing the burner apparatus attached to a wall of a furnace space.

Referring now to the drawings, the low $NO_x$ burner apparatus of the present invention is illustrated and generally designated by the numeral 10. As mentioned above, the burner apparatus 10 is capable of separately or simultaneously burning liquid and gaseous fuel with low $NO_x$ emissions. The burner 10 includes a housing 12 having an open discharge end 14 and a closed opposite end 16. As illustrated in FIG. 2, the open end 14 of the housing 12 is adapted to be connected to an opening 18 in a wall 20 of a furnace (shown in dashed lines). As will be understood by those skilled in the art, the furnace wall 18 generally includes an internal layer of insulation material 22 and the wall 20 and insulation material 22 define a furnace space 24 within which fuel and air are burned to form hot flue gases.

Figure 1:
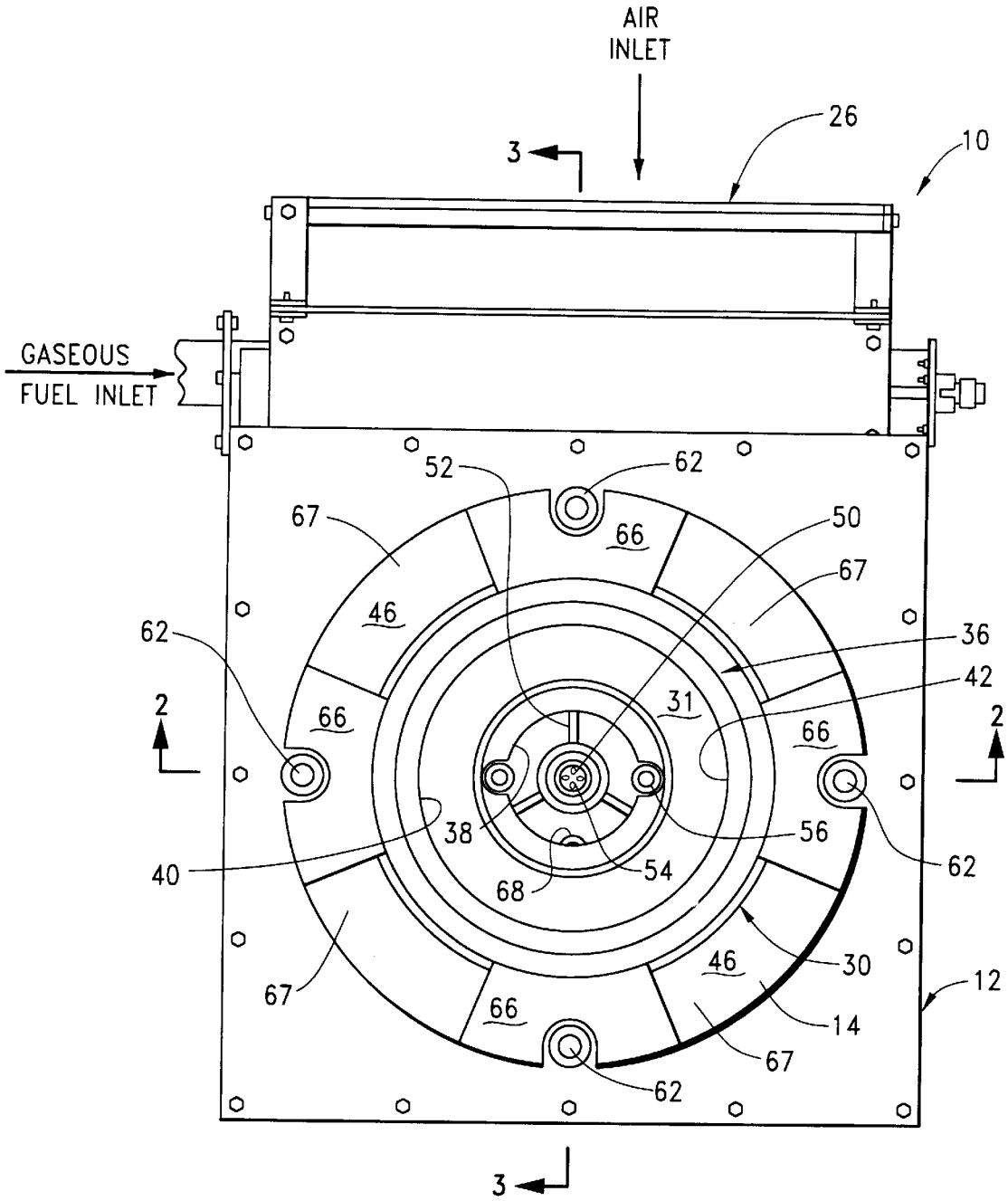
FIG. 1 is a top plan view of the burner apparatus of the present invention.
Figure 3:
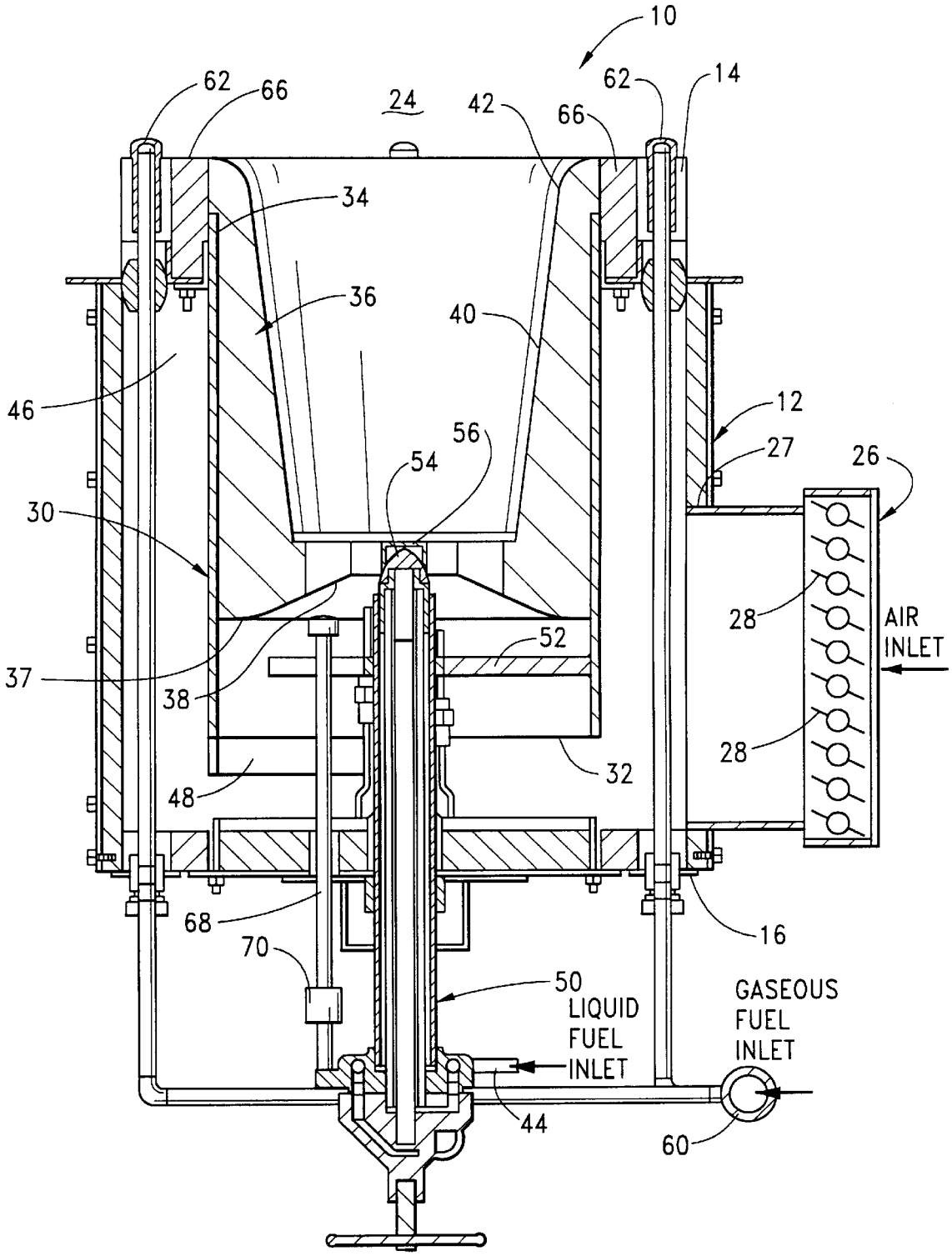
FIG. 3 is a side cross-sectional view of the burner apparatus of FIG. 1 taken along line 3—3 thereof.

As shown in FIGS. 1 and 3, an air register 26 is sealingly connected over an opening 27 in a side of the housing 12 for introducing a controlled quantity of air into the housing 12 and into the furnace space 24. The air register 26 includes louvers 28 or the like which can be adjusted to control the quantity of air flowing therethrough and into the housing 12.

A cylindrical combustion compartment 30 is disposed within the housing 12 for providing a primary combustion zone 31 therein. The compartment 30 includes an open inlet end 32 and an open discharge end 34 adjacent to the open end 14 of the housing 12. A ceramic tile 36 is connected within the compartment 30 which has a lower open end 37 thereof formed into a venturi throat 38, diverging sides 40 and an open upper end 42. As is best shown in FIGS. 2 and 3, the burner tile 36 forms a primary combustion zone 31 within the compartment 30.

The exterior of the combustion compartment 30 is smaller than the interior of the housing 12 whereby an annular discharge space 46 is provided between the combustion compartment 30 and the housing 12. As a result, a portion of the air introduced into the interior of the housing 12 by way of the air register 26 enters the interior of the combustion compartment 30 by way of the open inlet end 32 thereof as primary air. The remaining portion of the air enters the annular space 46 between the exterior of the combustion compartment 30 and the interior of the housing 12 and is discharged therefrom by way of the annular space 46 as secondary air. In order to properly distribute the air in the primary combustion zone 31 formed by the tile 36 within the combustion compartment 30, a semi-cylindrical air deflector 48 is integrally attached to the side of the bottom open end 32 of the combustion compartment 30 opposite from the air register 26. The deflector 48, which is best shown in FIGS. 2 and 3, functions to distribute air uniformly in the combustion compartment 30 and in the tile 36 therein.

A conventional liquid fuel atomizing gun 50 having a liquid fuel nozzle 54 extends through the housing 12 and a bracket 52 mounted in the combustion compartment 30 into the center of the venturi throat 38 of the tile 36. The liquid fuel gun 50 discharges atomized liquid fuel by way of the nozzle 54 into the combustion zone 31 in the tile 36. The liquid fuel atomizing gun 50 is connected to a source of liquid fuel by way of a conduit 44. The liquid fuel discharged into the primary combustion zone 31 mixes with a portion of the primary air in the zone and is burned therein.

As shown best in FIG. 2, a pair of primary gaseous fuel nozzles 56 are disposed within the venturi throat 38 of the tile 36 on opposite sides of the liquid fuel nozzle 54. The gaseous fuel nozzles 56 are connected by conduits 58 to a gaseous fuel inlet header 60 positioned below and outside the burner housing 12. The gaseous fuel nozzles 56 discharge primary gaseous fuel into the primary combustion zone 31 within the combustion compartment 30 so that the gaseous fuel along with the liquid fuel discharged by the nozzle 54 of the atomizing gun 50 combines with primary air therein, is combusted and is discharged into the furnace space 24.

As best shown in FIG. 1, four secondary gaseous fuel nozzles 62 for discharging secondary gaseous fuel into the furnace space 24 are attached to and spaced around the discharge end of the housing 12 within the annular space 46 between the exterior of the combustion compartment 30 and the interior of the housing 12. The nozzles 62 are connected to conduits 64 which are in turn connected to the gaseous fuel header 60. Four spaced air baffle members 66 are positioned in the annular space 46 adjacent to the secondary gaseous fuel nozzles 62 to shield the fuel nozzles 62 and to cause the secondary air flowing through the annular space 46 to be discharged into the furnace space 24 by way of spaced openings 67 formed between the baffle members 66. This staggered arrangement of the openings 67 and the discharge of the secondary air into the furnace space 24 allows the secondary air to entrain flue gases and carry them into the combustion zone thereby reducing thermal $NO_x$. The secondary gaseous fuel discharged by the nozzles 62 also mixes with flue gases in the furnace space 24, unburned liquid fuel discharged into the space 24 from the primary combustion zone 31 (when liquid fuel is simultaneously burned with gaseous fuel) and secondary air discharged from the spaces 67 between the baffles 66. The resulting mixture is burned in a secondary combustion zone in the furnace space 24 downstream of the primary combustion zone 31.

As shown in FIGS. 1 and 3, a pilot flame burner 68 is attached to and positioned within the housing 12 whereby the pilot flame produced thereby is located within the combustion compartment 30 adjacent to the venturi throat 38 in the tile 36. The pilot flame burner 68 is connected by a conduit 70 to the gaseous fuel inlet header 60.

In the operation of the burner apparatus 10 for simultaneously burning liquid and gaseous fuels with a substantially stoichiometric amount of air, primary air introduced into the housing 12 is mixed with the liquid fuel discharged from the liquid fuel nozzle 54 in the primary combustion zone 31 to form a fuel-rich mixture. The fuel-rich mixture is burned in the primary combustion zone 31 whereby flue gases having low $NO_x$ content are formed therefrom and the flue gases and unburned liquid fuel are discharged into the furnace space 24. Primary air is also mixed with a primary portion of the gaseous fuel discharged by the primary gaseous fuel nozzles 56 in the primary combustion zone 31. The primary air-primary gaseous fuel mixture is burned in the primary combustion zone 31 whereby flue gases having low $NO_x$ content are formed therefrom and are discharged into the furnace space 24. A secondary portion of the gaseous fuel is discharged by way of the secondary gaseous fuel nozzles 62 into the furnace space 24. Secondary air introduced into the housing 12 is discharged into the furnace space by way of the annular space 46 and the openings 67 between the baffles 66. The discharged secondary air mixes with flue gases in the furnace space 24, the secondary gaseous fuel discharged into the furnace space 24 by the nozzles 62 and the unburned liquid fuel discharged into the furnace space from the primary combustion zone 31 and the resulting mixture is burned in a secondary combustion zone in the furnace space 24 whereby additional flue gases are formed having low $NO_x$ content.

When only liquid fuel is burned in the burner apparatus 10 and when liquid fuel and gaseous fuel are burned simultaneously, the liquid fuel is burned in a deficiency of air in the primary combustion zone 31 producing a reducing environment that suppresses $NO_x$ formation. When only gaseous fuel is burned, a primary portion of the gaseous fuel is burned in the primary combustion zone 31 in a deficiency of air or in an excess of air. That is, thermal $NO_x$ is reduced by avoiding stoichiometric combustion and the combustion in the primary zone can be fuel-rich or fuel-lean with the combustion in the secondary zone being fuel-lean. When the combustion in the primary zone is fuel-rich, the division of the gaseous fuel is from about 16% to about 35% by volume in the primary zone with from about 65% to about 84% by volume in the secondary zone. When the combustion in the primary zone is fuel-lean, the division is from about 14% to about 25% by volume in the primary zone and from about 75% to 86% by volume in the secondary zone. The secondary gaseous fuel introduced into the furnace space 24 is diluted with flue gases and is burned with secondary air therein which produces additional flue gases having a low $NO_x$ content.

Thus, the low $NO_x$ forming burner apparatus of this invention which is adapted to be connected to a furnace space for burning liquid and gaseous fuels either independently or simultaneously is basically comprised of the following elements: a housing having an open discharge end and a closed opposite end; means for introducing a controlled quantity of air into the housing and into a furnace space attached to the housing; a combustion compartment disposed within the housing for providing a primary combustion zone therein having an open inlet end for receiving a portion of the air introduced into the housing as primary air and an open discharge end adjacent to the open discharge end of the housing, the combustion compartment being smaller than the housing whereby a portion of the air introduced into the housing passes through the annular space between the exterior of the combustion compartment and the interior of the housing and is discharged from the annular space at the discharge ends of the housing and the combustion compartment as secondary air; a liquid fuel nozzle attached to the housing for connection to a source of liquid fuel and for discharging liquid fuel into the primary combustion zone within the combustion compartment so that the liquid fuel mixes with primary air therein, is combusted therein and is discharged into the furnace space; at least one primary gaseous fuel nozzle attached to the housing for connection to a source of gaseous fuel and for discharging primary gaseous fuel into the primary combustion zone within the combustion compartment so that the gaseous fuel mixes with primary air therein, is combusted therein and is discharged into the furnace space; and at least one secondary gaseous fuel nozzle attached to the housing for connection to a source of gaseous fuel and for discharging secondary gaseous fuel into the furnace space which mixes with flue gases and the secondary air therein and is combusted therein.

The combustion compartment of the above described apparatus includes a venturi throat at the inlet of the primary combustion zone therein, and the liquid fuel nozzle is positioned in the housing whereby the liquid fuel is discharged into the primary combustion zone at the center of the venturi throat. Two primary gaseous fuel nozzles are preferably utilized attached to the housing for discharging the primary gaseous fuel into the primary combustion zone. The two primary gaseous fuel nozzles are preferably positioned on opposite sides of the liquid fuel nozzle and discharge primary gaseous fuel into the venturi throat of the primary combustion zone. Four secondary gaseous fuel nozzles which are equally spaced within and around the annular space at the discharge ends of the housing and the combustion compartment are preferably utilized for discharging secondary fuel into the furnace space. In addition, four spaced air baffles are preferably positioned in the annular space adjacent to the secondary gaseous fuel nozzles to shield the fuel nozzles and to cause the secondary air to be discharged from the annular space by way of openings between the baffle members. The apparatus also preferably includes an air deflector attached to the combustion compartment which extends from the open inlet end thereof towards the closed end of the housing and is positioned opposite the means for introducing air into the housing. Finally, the combustion zone which includes a venturi throat at the inlet end thereof is preferably formed by a ceramic tile attached within the combustion compartment, and a pilot flame burner is preferably attached to the housing and positioned therein whereby the pilot flame produced is located within the combustion compartment adjacent to the venturi throat in the ceramic tile whereby the pilot flame heats the hot tile surface which stabilizes the pilot flame.

The methods of the present invention for burning liquid and gaseous fuels with a substantially stoichiometric amount of air in a burner and in a furnace space to which the burner is attached whereby the flue gases have low $NO_x$ content are basically comprised of the following steps: (a) mixing primary air with a liquid fuel in a primary combustion zone in the burner to form a fuel-rich mixture; (b) burning the fuel-rich mixture of step (a) in the primary combustion zone whereby flue gases having low $NO_x$ content are formed therefrom and the flue gases and unburned liquid fuel are discharged into the furnace space; (c) mixing primary air with a primary portion of a gaseous fuel in the primary combustion zone in the burner; (d) burning the primary air-primary gaseous fuel mixture of step (c) in the primary combustion zone in the burner whereby flue gases having low $NO_x$ content are formed therefrom and are discharged into the furnace space; (e) discharging a secondary portion of the gaseous fuel into the furnace space; and (f) discharging secondary air into the furnace space so that the secondary air mixes with flue gases in the furnace space, the secondary gaseous fuel discharged therein in accordance with step (e) and unburned liquid fuel discharged therein in accordance with step (b), and the resulting mixture is burned in a secondary combustion zone in the furnace space whereby additional flue gases are formed having low $NO_x$ content.

The primary air mixed with the liquid fuel and the primary air mixed with the gaseous fuel in accordance with steps (a) and (c) preferably comprise a combined amount of air in the range of from about 15% to about 30% by volume of the total air introduced into the burner and furnace space. In addition, the first portion of the gaseous fuel mixed with primary air in accordance with step (c) is preferably an amount in the range of from about 16% to about 35% by volume of the total gaseous fuel burned in said burner and in said furnace space.

Thus, the present invention is well adapted to carry out the objects and attain the ends and advantages mentioned as well as those which are inherent therein. While presently preferred embodiments of the invention have been described for purposes of this disclosure, numerous changes in the construction and in the arrangement of parts and steps will suggest themselves to those skilled in the art which are encompassed within the spirit of this invention as defined by the appended claims.

What is claimed is:

1. A low $NO_x$ forming burner apparatus for burning liquid and gaseous fuels adapted to be connected to a furnace space comprising:

a housing having an open discharge end attached to said furnace space and a closed opposite end;

means for introducing a controlled quantity of air into said housing and into said furnace space attached to said housing;

a combustion compartment disposed within said housing for providing a primary combustion zone therein having an open inlet end for receiving a portion of the air introduced into said housing as primary air and an open discharge end adjacent to said open discharge end of said housing, said combustion compartment being smaller than said housing whereby a portion of said air introduced into said housing passes through an annular space between the exterior of said compartment and the interior of said housing and is discharged from said annular space at the discharge ends of said housing and said compartment as secondary air;

a liquid fuel nozzle attached to said housing for connection to a source of liquid fuel and for discharging liquid fuel into said primary combustion zone within said compartment so that said liquid fuel mixes with primary air therein and is combusted therein whereby flue gases are formed therefrom and are discharged into said furnace space;

at least one primary gaseous fuel nozzle attached to said housing for connection to a source of gaseous fuel and for discharging primary gaseous fuel into said primary combustion zone within said compartment so that said gaseous fuel mixes with primary air therein, is combusted therein whereby flue gases are formed therefrom and are discharged into said furnace space;

four secondary gaseous fuel nozzles attached to said housing for connection to a source of gaseous fuel and for discharging secondary gaseous fuel into said furnace space which mixes with flue gases and said secondary air therein and is combusted therein, said secondary fuel nozzles being equally spaced within and around said annular space at the discharge ends of said housing and said combustion compartment; and four spaced air baffle members positioned in said annular space adjacent to said secondary gaseous fuel nozzles to shield said fuel nozzles and to cause said secondary air to be discharged from said annular space by way of openings between said baffle members.

2. The apparatus of claim 1 wherein said combustion compartment includes a venturi throat at the inlet of said primary combustion zone therein.

3. The apparatus of claim 2 wherein said liquid fuel nozzle is positioned in said housing whereby said liquid fuel is discharged into said combustion compartment and into said primary combustion zone therein at the center of said venturi throat therein.

4. The apparatus of claim 1 wherein two primary gaseous fuel nozzles are attached to said housing for discharging primary gaseous fuel into said primary combustion zone within said combustion compartment.

5. The apparatus of claim 4 wherein said primary gaseous fuel nozzles are positioned on opposite sides of said liquid fuel nozzle and discharge primary gaseous fuel into said venturi throat.

6. The apparatus of claim 1 which further comprises an air deflector attached to said combustion compartment which extends from said open inlet end thereof towards said closed end of said housing and is positioned opposite said means for introducing air into said housing.

7. The apparatus of claim 2 wherein said primary combustion zone and said venturi throat in said combustion chamber are formed by a burner tile.

8. The apparatus of claim 7 which further comprises a pilot flame burner attached to said housing and positioned therein whereby the pilot flame produced is located within said combustion compartment adjacent to said venturi throat in said burner tile therein.

9. A method of burning liquid and gaseous fuels with a substantially stoichiometric amount of air in a burner and in a furnace space to which the burner is attached whereby flue gases having low $NO_x$ content are formed therefrom comprising the steps of:

(a) mixing primary air with a liquid fuel in a primary combustion zone in said burner to form a mixture;

(b) burning said mixture of step (a) in said primary combustion zone whereby flue gases having low $NO_x$ content are formed therefrom and said flue gases and unburned liquid fuel are discharged into said furnace space;

(c) mixing primary air with a primary portion of a gaseous fuel in said primary combustion zone in said burner;

(d) burning said primary air-primary gaseous fuel mixture of step (c) in said primary combustion zone in said burner whereby flue gases having low $NO_x$ content are formed therefrom and are discharged into said furnace space;

(e) discharging a secondary portion of said gaseous fuel into said furnace space; and (f) discharging secondary air into said furnace space so that said secondary air mixes with flue gases in said furnace space, the secondary gaseous fuel discharged therein in accordance with step (e) and unburned liquid fuel discharged therein in accordance with step (b), and the resulting mixture is burned in a secondary combustion zone in said furnace space whereby additional flue gases are formed having low $NO_x$ content.

10. The method of claim 9 wherein said mixture of step (a) is fuel-rich.

11. The method of claim 9 wherein said mixture of step (c) is fuel-lean.

12. The method of claim 9 wherein said mixture of step (c) is fuel-rich.

13. The method of claim 9 wherein said primary air is mixed with said liquid fuel in accordance with step (a) by discharging said liquid fuel from a liquid fuel nozzle into a venturi throat formed in said primary combustion zone which causes said primary air to be drawn into said primary combustion zone and mixed with said liquid fuel therein.

14. The method of claim 13 wherein said primary air is mixed with said first portion of said gaseous fuel in accordance with step (c) by discharging said first portion of said gaseous fuel from two primary gaseous fuel nozzles into said venturi throat which causes said air to be drawn into said primary combustion zone and mixed with said gaseous fuel therein.

15. The method of claim 14 wherein the secondary gaseous fuel discharged into said furnace space in accordance with step (e) is discharged therein by four secondary gaseous fuel discharge nozzles.

16. The method of claim 9 wherein said primary air mixed with said liquid fuel and said primary air mixed with said gaseous fuel in accordance with steps (a) and (c) comprise a combined amount of air in the range of from about 15% to about 30% by volume of the total air introduced into said burner and furnace space.

17. The method of claim 9 wherein said first portion of said gaseous fuel mixed with air in accordance with step (c) is an amount in the range of from about 14% to about 35% by volume of the total gaseous fuel burned in said burner and in said furnace space.

18. A low $NO_x$ forming burner apparatus for burning liquid and gaseous fuels adapted to be connected to a furnace space comprising:

a housing having an open discharge end attached to said furnace space and a closed opposite end;

means for introducing a controlled quantity of air into said housing and into said furnace space attached to said housing;

a combustion compartment disposed within said housing for providing a primary combustion zone therein having an open inlet end for receiving a portion of the air introduced into said housing as primary air and an open discharge end adjacent to said open discharge end of said housing, said combustion compartment being smaller than said housing whereby a portion of said air introduced into said housing passes through an annular space between the exterior of said compartment and the interior of said housing and is discharged from said annular space at the discharge ends of said housing and said compartment as secondary air;

a liquid fuel nozzle attached to said housing for connection to a source of liquid fuel and for discharging liquid fuel into said primary combustion zone within said compartment so that said liquid fuel mixes with primary air therein and is combusted therein whereby flue gases are formed therefrom and are discharged into said furnace space;

at least one primary gaseous fuel nozzle attached to said housing for connection to a source of gaseous fuel and for discharging primary gaseous fuel into said primary combustion zone within said compartment so that said gaseous fuel mixes with primary air therein, is combusted therein whereby flue gases are formed therefrom and are discharged into said furnace space;

at least one secondary gaseous fuel nozzle attached to said housing for connection to a source of gaseous fuel and for discharging secondary gaseous fuel into said furnace space which mixes with flue gases and said secondary air therein and is combusted therein; and an air deflector attached to said combustion compartment which extends from said inlet end thereof towards said closed end of said housing and is positioned opposite said means for introducing air into said housing.

19. The apparatus of claim 18 wherein said combustion compartment includes a venturi throat at the inlet of said primary combustion zone therein.

20. The apparatus of claim 19 wherein said liquid fuel nozzle is positioned in said housing whereby said liquid fuel is discharged into said combustion compartment and into said primary combustion zone therein at the center of said venturi throat therein.

21. The apparatus of claim 18 wherein two primary gaseous fuel nozzles are attached to said housing for discharging primary gaseous fuel into said primary combustion zone within said combustion compartment.

22. The apparatus of claim 21 wherein said primary gaseous fuel nozzles are positioned on opposite sides of said liquid fuel nozzle and discharge primary gaseous fuel into said venturi throat.

23. The apparatus of claim 18 wherein four secondary gaseous fuel nozzles are attached to said housing for discharging secondary fuel into said furnace space.

24. The apparatus of claim 23 wherein said four secondary gaseous fuel nozzles are equally spaced within and around said annular space at the discharge ends of said housing and said combustion compartment.

25. The apparatus of claim 24 which further comprises four spaced air baffle members positioned in said annular space adjacent to said secondary gaseous fuel nozzles to shield said fuel nozzles and to cause said secondary air to be discharged from said annular space by way of openings between said baffle members.

26. The apparatus of claim 19 wherein said primary combustion zone and said venturi throat in said combustion chamber are formed by a burner tile.

27. The apparatus of claim 26 which further comprises a pilot flame burner attached to said housing and positioned therein whereby the pilot flame produced is located within said combustion compartment adjacent to said venturi throat in said burner tile therein.

* * * * *